US006871923B2

(12) United States Patent
Dietz et al.

(10) Patent No.: US 6,871,923 B2
(45) Date of Patent: Mar. 29, 2005

(54) SPILL-PROOF REFRIGERATOR SHELF

(75) Inventors: Larry E. Dietz, Galesburg, IL (US); Timothy J. Thuline, Galva, IL (US)

(73) Assignee: Maytag Corporation, Newton, IA (US)

( * ) Notice: Subject to any disclaimer, the term of this patent is extended or adjusted under 35 U.S.C. 154(b) by 30 days.

(21) Appl. No.: 10/252,358

(22) Filed: Sep. 24, 2002

(65) Prior Publication Data

US 2004/0056575 A1 Mar. 25, 2004

(51) Int. Cl.[7] ..... A47B 81/00
(52) U.S. Cl. ..... 312/408; 312/410; 108/27
(58) Field of Search ..... 312/408, 410; 108/27; 211/153; 264/274; 62/382, 465

(56) References Cited

U.S. PATENT DOCUMENTS

| | | | | |
|---|---|---|---|---|
| 1,119,982 A | * | 12/1914 | Ohnstrand | 211/153 |
| 2,429,709 A | * | 10/1947 | Curtisss, Jr. | 211/153 |
| 4,934,541 A | | 6/1990 | Bussan et al. | |
| 4,936,641 A | | 6/1990 | Bussan et al. | |
| D309,461 S | | 7/1990 | Bussan et al. | |
| 5,228,764 A | | 7/1993 | Cherry et al. | |
| 5,273,354 A | | 12/1993 | Herrmann et al. | |
| 5,332,611 A | * | 7/1994 | Shanok et al. | 108/27 |
| 5,362,145 A | | 11/1994 | Bird et al. | |
| 5,403,084 A | | 4/1995 | Kane et al. | |
| 5,429,433 A | | 7/1995 | Bird et al. | |
| 5,516,204 A | | 5/1996 | Calvert et al. | |
| 5,540,493 A | | 7/1996 | Kane et al. | |
| 5,947,574 A | * | 9/1999 | Avendano | 312/408 |
| 6,045,101 A | | 4/2000 | Goyette et al. | |
| 6,105,233 A | | 8/2000 | Neal | |
| 6,170,276 B1 | | 1/2001 | Mandel et al. | |
| 6,558,601 B1 | * | 5/2003 | Reames et al. | 264/274 |

FOREIGN PATENT DOCUMENTS

| | | |
|---|---|---|
| EP | 520786 | * 12/1992 |
| EP | 886116 | * 12/1998 |

* cited by examiner

*Primary Examiner*—Lanna Mai
*Assistant Examiner*—Hanh V. Tran
(74) *Attorney, Agent, or Firm*—Diederiks & Whitelaw, PLC

(57) ABSTRACT

A removable, spill-proof refrigerator shelf includes a glass shelf panel, a one-piece molded plastic frame member extending about the periphery of and supporting the glass shelf panel, and an adhesive injected into a channel created by the frame member for sealingly fixing the shelf panel within the frame member. The top of the adhesive is made flush with the top surface of the shelf panel, thereby forming a substantially continuous and easily cleaned surface. An integral outer rim is provided about the periphery of the frame member and acts as a barrier to prevent any liquid spilled on the shelf from flowing onto shelves and/or food below.

20 Claims, 2 Drawing Sheets

SPILL-PROOF REFRIGERATOR SHELF

BACKGROUND OF THE INVENTION

1. Field of the Invention

The present invention pertains to the art of refrigerators and, more particularly, to a removable, spill-proof refrigerator shelf which is economical to manufacture.

2. Discussion of the Prior Art

Modern refrigerator shelves often include a shelf panel supported by multiple frame members. The frame members cooperate to sandwich the periphery of the panel there between. Gaps often exist between the panel and the frame members that allow liquid spilled on the panel to run off the refrigerator shelf through the gaps and spill onto other shelves and/or food items below. One proposed solution to this problem has been to add a sealant between the frame and shelf panel in order to contain liquids within the confines of the shelf. However, this arrangement requires the sealant to be placed precisely in order to assure a proper seal. Additionally, liquid spilled on the shelf may still seep into gaps between the frame and the glass, making the shelf much more difficult, if not impossible, to clean, which could possibly lead to unsanitary conditions.

Another common type of refrigerator shelf includes a rim or frame member that is molded about the periphery of a shelf panel, thereby creating an inherent seal between the rim and the shelf panel. However, manufacturing processes for this type of shelf require multiple steps and specialized molding equipment that significantly add to the cost of production. Even with this arrangement, additional sealants may be required to assure a proper seal between the rim and shelf panel.

Based on the above, there exists a need for a spill-proof refrigerator shelf which can be easily cleaned and which can be simply manufactured to reduce costs.

SUMMARY OF THE INVENTION

The present invention is directed to a low cost spill-proof shelf assembly for a refrigerator. In accordance with the invention, the assembly includes a glass shelf panel which is supported by a single frame member and sealingly attached thereto by an adhesive. In the preferred embodiment, the shelf panel is placed on and supported by a frame member that has a substantially J-shaped cross section and includes side wall, bottom wall and bearing wall portions.

In accordance with the most preferred form of the invention, the bearing wall portion of the frame member supports the shelf panel such that a peripheral edge portion of the shelf panel is cantilevered over the bearing wall section. The peripheral edge portion of the shelf panel and the side wall, bottom wall and bearing wall portions define a generally L-shaped channel in the frame member. An adhesive fills the channel and secures the shelf panel to the frame member in a fluid tight manner. The amount of adhesive supplied to the channel is such that the top of the adhesive layer is made flush with the top of the shelf panel, thereby providing a continuous and easily cleaned shelf surface. The frame member includes a top end portion which extends above the shelf panel and defines a rim. The rim acts as a barrier to prevent any liquid spilled on the shelf assembly from dripping off the shelf assembly and onto shelves and/or food below.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
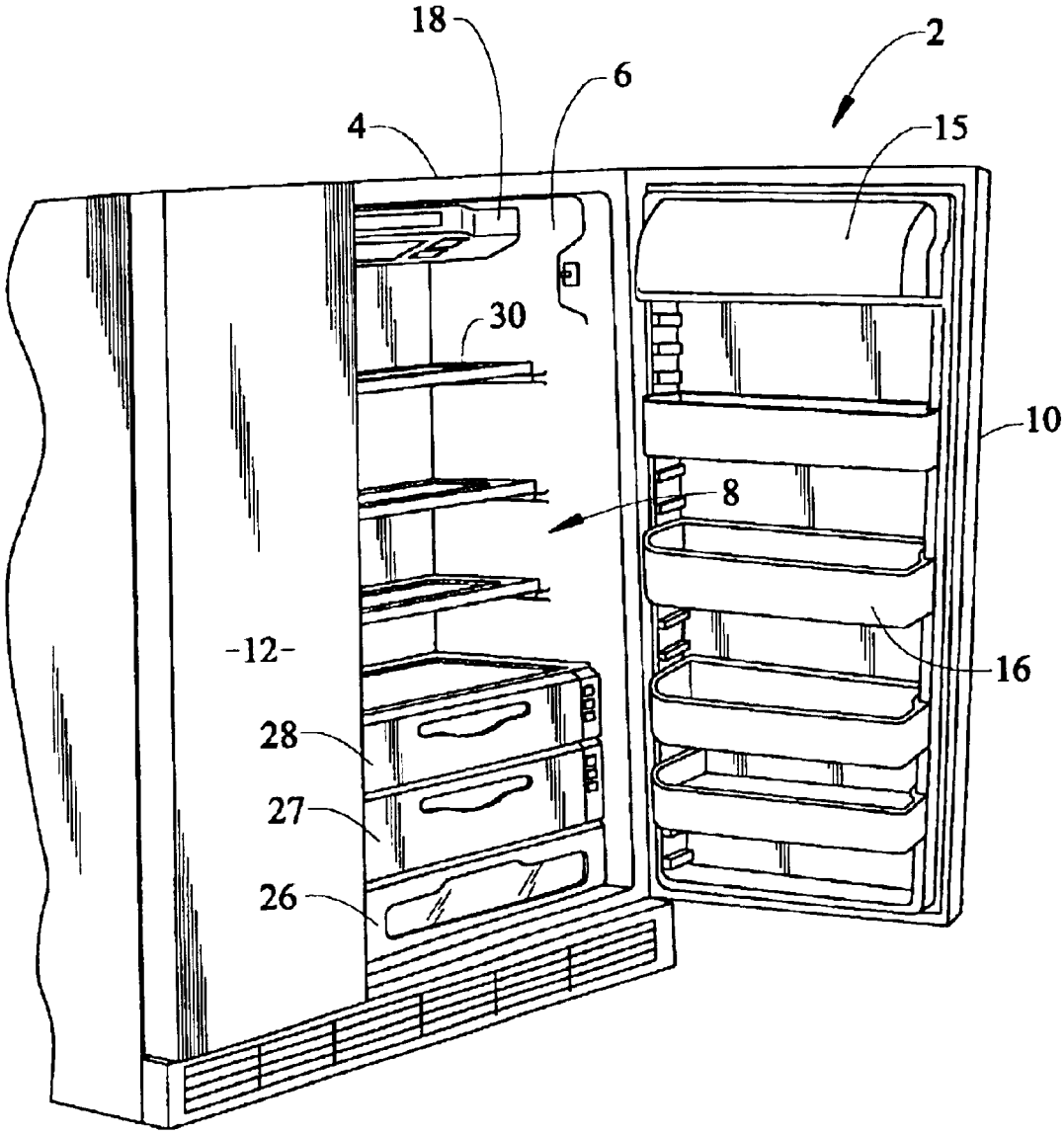
FIG. 1 is a partial, front perspective view of a side-by-side refrigerator incorporating a spill-proof shelf assembly constructed in accordance with the present invention.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator cabinet 2 is shown to include a dairy compartment 15 and various vertically adjustable shelving units, one of which is indicated at 16. Mounted in an upper region of fresh food compartment 8 is a temperature control housing 18 which, in a manner known in the art, can be used to regulate the temperature in both fresh food compartment 8 and the freezer compartment. At a lowermost portion of fresh food compartment 8 is illustrated various slidable bins, i.e., a lowermost bin 26 and higher, individually temperature controlled bins 27 and 28.

To this point, the above-described structure is known in the art and presented only for the sake of completeness. This structure is actually more fully described in U.S. Pat. No. 6,170,276 which is incorporated herein by reference. The present invention is actually directed to a removable, spill-proof shelf assembly generally indicated at 30. Although FIG. 1 illustrates three such shelf assemblies 30, it should be realized that the actual number of shelf assemblies can be readily varied.

Figure 2:
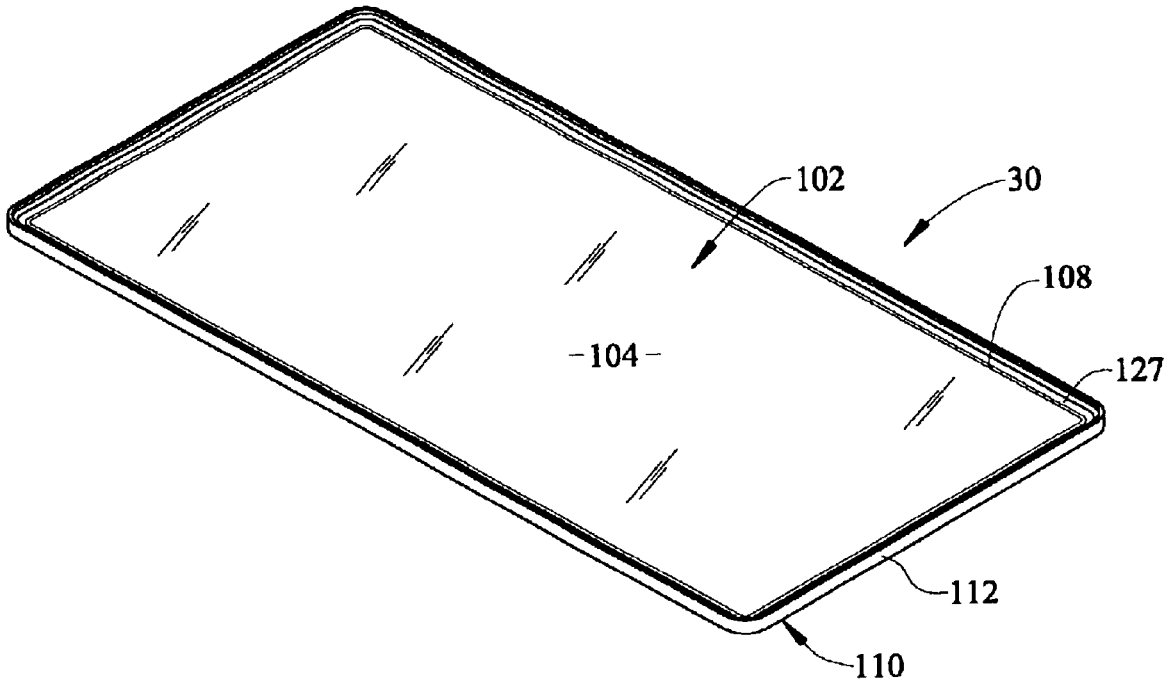
FIG. 2 is an enlarged perspective view of the spill-proof shelf assembly of FIG. 1.
Figure 3:
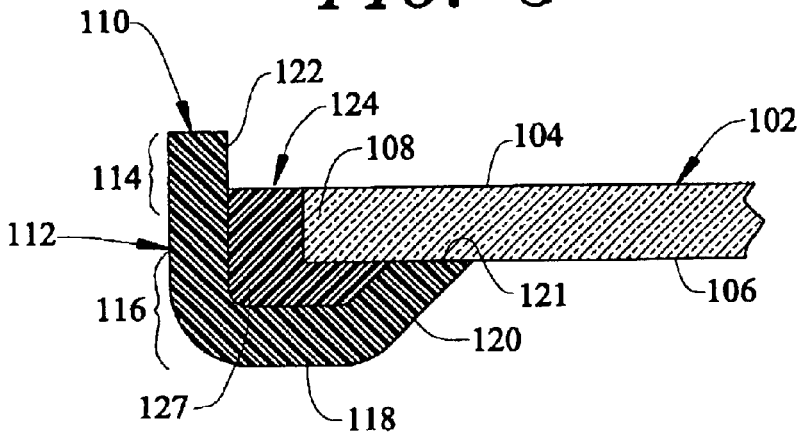
FIG. 3 is a cross-sectional view of an edge portion of the shelf assembly of FIG. 2.

Reference will now be made to FIGS. 2 and 3 in describing the preferred embodiment of spill-proof shelf assembly 30 of the present invention. As illustrated, shelf assembly 30 includes a preferably rectangular shelf panel 102 having upper and lower spaced surfaces 104 and 106, and a peripheral edge portion 108. Preferably, shelf panel 102 is constituted by a planar glass panel. Shelf assembly 30 also includes a frame member 110, preferably constituted by a single piece of plastic which is molded in a rectangular shape, with a substantially J-shaped cross-section. More specifically, frame member 110 includes a side wall section 112 having a top end portion 114 and a bottom end portion 116, a base wall section 118 formed integrally with and extending from the bottom end portion 116 of side wall section 112, and a bearing wall section 120. As shown, bearing wall section 120 is integrally formed with, and extends upwardly from, base wall section 118. Shelf panel 102 is supported on bearing wall section 120 such that peripheral edge portion 108 is cantilevered over bearing wall section 120 and spaced apart from side wall section 112. Preferably, bearing wall section 120 defines a planar support surface 121 on which the lower surface 106 of shelf panel 102 is supported. The top end portion 114 of side wall section 112 projects above upper surface 104 of shelf panel 102 and defines a rim 122 about the periphery of spill-proof shelf assembly 30.

Peripheral edge portion 108, side wall section 112, lower surface 106 of shelf panel 102, base wall section 118 and bearing wall section 120 collectively define a channel 124 which is filled with an adhesive 127. Adhesive 127 secures peripheral edge portion 108 of shelf panel 102 to frame member 110 in a fluid tight manner. In the most preferred embodiment of the invention, bearing wall section 120 is arranged at an obtuse angle with respect to base wall section 118, thus advantageously establishing a larger surface area upon which lower surface 106 rests. The cantilevered arrangement of peripheral edge portion 108 actually defines an undercut zone (not separately labeled) into which adhesive 127 extends. Therefore, channel 124 is generally L-shaped in cross-section. In any event, adhesive 127 fixes shelf panel 102 to frame member 110. Most preferably, the top of adhesive 127 is established flush with upper surface 104 of shelf panel 102, thereby providing a continuous and easily cleaned shelf surface. With this arrangement, any small amount of liquid spilled on upper surface 106 of shelf assembly 30 will be contained thereon by rim 122.

In addition to having an easily cleaned, spill-proof surface as described above, shelf assembly 30 has the advantage of being simply constructed and relatively inexpensive to manufacture. As indicated above, frame member 110 is preferably molded of plastic. As is known in the art, pigments or dyes may be added during the molding process to produce a frame member 110 of a desired color. Shelf panel 102 is then placed onto frame member 110 such that peripheral edge portion 108 is spaced from side wall section 112 and cantilevered over bearing wall section 120. Adhesive 127 is then injected into channel 124 until flush with upper surface 104 of shelf panel 102. Adhesive 127 is preferably constituted by DOW RTV-739, but may be any other type of adhesive that provides a water or other fluid tight seal between shelf panel 102 and frame member 110. Planar support surface 121 of bearing wall section 120 directly contacts lower surface 106 of shelf panel 102 and aids in preventing uncured adhesive 127 from spilling out between bearing wall section 120 and lower surface 106 of shelf panel 102. Upon curing of adhesive 127, a hard, substantially continuous and easily cleaned shelf surface is produced.

Although described with reference to a preferred embodiment of the invention, it should be readily understood that various changes and/or modifications can be made to the invention without departing from the spirit thereof. For instance, at the time of manufacturing, recesses, projections, rails, or the like, associated with supporting removable shelf assembly 30 in the refrigerator cabinet 2, may be integrally molded into frame member 110. In general, the invention is only intended to be limited by the scope of the following claims.

We claim:

1. In a refrigerator including a liner mounted within a cabinet shell so as to define a refrigerator storage compartment, a spill-proof shelf assembly for supporting articles comprising:

a shelf panel having upper and lower spaced surfaces and a peripheral edge portion;

a frame member having a side wall section with a top end portion and a bottom end portion, a base wall section formed integral with and extending from the bottom end portion of the side wall section, and a bearing wall section integrally formed with and extending upward from the base wall section at a position spaced from the side wall section, said shelf panel being supported on said bearing wall section with the peripheral edge portion of the shelf panel being spaced from the side wall section and cantilevered over the bearing wall section, and the top end portion of said side wall section projecting above the shelf panel and defining a rim, wherein the peripheral edge portion, the side wall section, the lower surface of the shelf panel, the base wall section and the bearing wall section collectively define a channel; and an adhesive filling said channel and securing the peripheral edge portion of the shelf panel to the frame member in a fluid tight manner, wherein liquid spilled on the shelf is prevented from spilling off the shelf assembly by the rim.

2. The spill-proof shelf assembly of claim 1, wherein a top of the adhesive is substantially flush with the upper surface of the shelf panel, thereby forming a continuous and easily cleaned shelf surface.

3. The spill-proof shelf assembly of claim 1, wherein the shelf panel constitutes a rectangular glass panel.

4. The spill-proof shelf assembly of claim 3, wherein the shelf panel has planar upper and lower surfaces.

5. The spill-proof shelf assembly of claim 1, wherein the bearing wall section extends at an obtuse angle with respect to the base wall section.

6. The spill-proof shelf assembly of claim 5, wherein the bearing wall section defines a substantially planar surface on which the shelf panel is supported.

7. The spill-proof shelf assembly of claim 1, wherein the frame member has a substantially J-shaped cross-section.

8. A spill-proof refrigerator shelf assembly adapted to support articles within a refrigerator comprising:

a shelf panel having upper and lower spaced surfaces and a peripheral edge portion;

a frame member having a side wall section with a top end portion and a bottom end portion, a base wall section formed integral with and extending from the bottom end portion of the side wall section, and a bearing wall section integrally formed with and extending upward from the base wall section at a position spaced from the side wall section, said shelf panel being supported on said bearing wall section with the peripheral edge portion of the shelf panel being spaced from the side wall section and cantilevered over the bearing wall section, and the top end portion of said side wall section projecting above the shelf panel and defining a rim, wherein the peripheral edge portion, the side wall section, the lower surface of the shelf panel, the base wall section and the bearing wall section collectively define a channel; and an adhesive filling said channel and securing the peripheral edge portion of the shelf panel to the frame member in a fluid tight manner, wherein liquid spilled on the shelf is prevented from spilling off the shelf assembly by the rim.

9. The spill-proof shelf assembly of claim 8, wherein a top of the adhesive is substantially flush with the upper surface of the shelf panel, thereby forming a continuous and easily cleaned shelf surface.

10. The spill-proof shelf assembly of claim 8, wherein the shelf panel constitutes a rectangular glass panel.

11. The spill-proof shelf assembly of claim 10, wherein the shelf panel has planar upper and lower surfaces.

12. The spill-proof shelf assembly of claim 8, wherein the bearing wall section extends at an obtuse angle with respect to the base wall section.

13. The spill-proof shelf assembly of claim 12, wherein the bearing wall section defines a substantially planar surface on which the shelf panel is supported.

14. The spill-proof shelf assembly of claim 8, wherein the frame member has a substantially J-shaped cross-section.

15. A method of manufacturing a spill-proof shelf comprising:

forming a frame member having a substantially J-shaped cross section including a side wall section with a top end portion and a bottom end portion, a base wall section formed integral with and extending from the bottom end portion of the side wall section, and a bearing wall section integrally formed with and extending upward from the base wall section at a position spaced from the side wall section;

placing a shelf panel having upper and lower spaced surfaces and a peripheral edge portion on the frame member such that the lower surface of the shelf panel is supported by the bearing surface of the frame member and the peripheral edge portion is cantilevered over the bearing wall section and spaced from the side wall section, and the upper end portion of the side wall section projects above the shelf panel to define a rim; and pouring adhesive in a channel collectively defined by the peripheral edge portion, the side wall section, the lower surface of the shelf panel, the base wall section and the bearing wall section to seal the shelf panel to the frame member in a fluid tight manner.

16. The method of claim 15, further comprising: pouring the adhesive into the channel until a top of the adhesive is arranged substantially flush with the upper surface of the shelf panel, thereby forming a continuous and easily cleaned shelf surface.

17. The method of claim 15, further comprising: forming the shelf panel from a rectangular glass panel.

18. The method of claim 17, further comprising: forming the shelf panel with planar upper and lower surfaces.

19. The method of claim 15, further comprising: extending the bearing wall section at an obtuse angle with respect to the base wall section.

20. The method of claim 19, further comprising: supporting the shelf panel on a substantially planar surface of the bearing wall section.

* * * * *